US011237520B2

(12) United States Patent
Fussinger et al.

(10) Patent No.: US 11,237,520 B2
(45) Date of Patent: Feb. 1, 2022

(54) COMPONENT FOR A TIMEPIECE MOVEMENT

(71) Applicant: Nivarox-FAR S.A., Le Locle (CH)

(72) Inventors: Alexandre Fussinger, Wavre (CH); Christian Charbon, Chezard-St-Martin (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 426 days.

(21) Appl. No.: 15/652,283

(22) Filed: Jul. 18, 2017

(65) Prior Publication Data

US 2018/0024501 A1 Jan. 25, 2018

(30) Foreign Application Priority Data

Jul. 19, 2016 (EP) ..... 16180226
Sep. 23, 2016 (EP) ..... 16190278
Feb. 21, 2017 (EP) ..... 17157065

(51) Int. Cl.

*G04B 13/02* (2006.01)
*G04B 17/32* (2006.01)
*G04B 15/14* (2006.01)
*G04B 43/00* (2006.01)
*G04B 1/16* (2006.01)

(52) U.S. Cl.

CPC ..... *G04B 13/022* (2013.01); *G04B 1/16* (2013.01); *G04B 13/02* (2013.01); *G04B 13/026* (2013.01); *G04B 15/14* (2013.01); *G04B 17/32* (2013.01); *G04B 43/007* (2013.01)

(58) Field of Classification Search

CPC ..... G04B 1/16; G04B 13/02; G04B 13/026; G04B 15/14; G04B 17/32; G04B 43/007
See application file for complete search history.

(56) References Cited

U.S. PATENT DOCUMENTS 3,099,128 A 7/1963 Straumann
3,683,616 A 8/1972 Steinemann et al.
4,336,082 A * 6/1982 Kimura ..... C22C 9/08 148/433
2011/0164478 A1* 7/2011 Conus ..... G04B 31/008 368/324

(Continued)

FOREIGN PATENT DOCUMENTS

CH 681370 3/1993
CH 696506 7/2007

(Continued)

OTHER PUBLICATIONS

Office Action dated Nov. 16, 2020, in Russian patent Application No. 2017125745, with English translation (17 pages).
Office Action dated Mar. 22, 2021, in Russian patent application No. 2017125745, with English translation—19 pages.
A.F. Krainev, Mechanics of Machines. The Fundamental Dictionary. Moscow, publishing house "Mashinostroenie", 2000, p. 745 with English translation—5 pages.

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A pivot arbor for a timepiece movement includes a pivot made of a first non-magnetic metal material at at least one end in order to limit the sensitivity to magnetic fields. An outer surface of the pivot is coated with a first layer of a second material such as Ni, NiB, and/or NiP. The first layer of the second material is partially coated with a second layer of a third material selected from gold, silver, copper, platinum, rhodium, palladium and their alloys.

28 Claims, 1 Drawing Sheet

(56) References Cited

U.S. PATENT DOCUMENTS

| | | | | |
|---|---|---|---|---|
| 2013/0287955 | A1* | 10/2013 | Portet | C10M 105/04 427/318 |
| 2013/0333504 | A1* | 12/2013 | Klinger | F16H 55/18 74/409 |
| 2014/0198625 | A1* | 7/2014 | Von Gruenigen | G04B 1/16 368/124 |
| 2014/0261925 | A1* | 9/2014 | Wetzel | C22C 9/06 148/684 |
| 2015/0072138 | A1* | 3/2015 | Takazaki | C23C 14/0015 428/336 |
| 2015/0378309 | A1 | 12/2015 | Von Gruenigen et al. | |
| 2019/0041799 | A1 | 2/2019 | Gaugey | |

FOREIGN PATENT DOCUMENTS

| | | | | |
|---|---|---|---|---|
| CH | 707504 | A2 * | 7/2014 | G04B 43/007 |
| EP | 1237058 | | 9/2002 | |
| FR | 2015873 | | 4/1970 | |
| JP | S54-085127 | | 7/1979 | |

OTHER PUBLICATIONS

M.A. Shcherbakova. Methodical Recommendations for the Implementation of Practical Work for the Professional Module PM.03. Welding Quality Control. ROSZHELDOR. FSBEI HPE RSTU, TTSRT—a branch of RSTU, Tikhoretsk, 2015, practical work 22, theoretical information + partial translation 86 pages.

Japanese Office Action dated Jun. 8, 2021, in Japanese Patent Application No. 2019-118340 (with English Translation).

* cited by examiner

COMPONENT FOR A TIMEPIECE MOVEMENT

This application claims priorities from European patent applications No. 16180226.9 filed on Jul. 19, 2016, No 16190278.8 of Sep. 23, 2016 and No 17157065.8 of Feb. 21, 2017, the entire disclosures of which are hereby incorporated herein by reference.

FIELD OF THE INVENTION

The invention relates to a component for a timepiece movement and particularly to a non-magnetic pivot arbor for a mechanical timepiece movement and more particularly to a non-magnetic balance staff, pallet staff and escape pinion.

BACKGROUND OF THE INVENTION

The manufacture of a pivot arbor for a timepiece consists in performing bar turning operations on a hardenable steel bar to define various active surfaces (bearing surface, shoulder, pivots, etc.) and then in subjecting the bar-turned arbor to heat treatments comprising at least one hardening operation to improve the hardness of the arbor and one or more tempering operations to improve its tenacity. The heat treatment operations are followed by an operation of rolling the pivots of the arbors, which consists in polishing the pivots to the required dimensions. The hardness and roughness of the pivots are further improved during the rolling operation.

The pivot arbors, for example the balance staffs, conventionally used in mechanical timepiece movements are made of steel grades for bar turning which are generally martensitic carbon steels comprising lead and manganese sulphides to improve their machinability. A known steel of this type, named 20AP, is typically used for these applications.

This type of material has the advantage of being easy to machine, in particular of being suitable for bar turning and, after hardening and tempering, has superior mechanical properties which are very advantageous for making timepiece pivot arbors. These steels exhibit, particularly after heat treatment, a high hardness, making it possible to obtain a very good shock resistance. Typically, the hardness of arbor pivots made of 20AP steel can exceed 700 HV after heat treatment and rolling.

Although this type of material provides satisfactory mechanical properties for the horological applications described above, it has the drawback of being magnetic and capable of interfering with the working of a watch after being subjected to a magnetic field, particularly when the material is used to make a balance staff cooperating with a balance spring made of ferromagnetic material. This phenomenon is well known to those skilled in the art. It will also be noted that these martensitic steels are also sensitive to corrosion.

Attempts have been made to try to overcome these drawbacks with austenitic stainless steels, which have the peculiarity of being non-magnetic, namely paramagnetic or diamagnetic or antiferromagnetic. However, these austenitic steels have a crystallographic structure, which does not allow them to be hardened and to achieve levels of hardness and thus of shock resistance compatible with the requirements necessary for making timepiece pivot arbors. The arbors obtained then exhibit marks or severe damage in the event of shocks, which will then have a negative effect on the chronometry of the movement. One means of increasing the hardness of these steels is cold working, however this hardening operation cannot achieve hardnesses of more than 500 HV. Consequently, for parts requiring pivots exhibiting a high shock resistance, the use of this type of steels remains limited.

Another approach to try to overcome these drawbacks is described in EP Patent Application 2757423. According to this approach, the pivot arbors are made of an austenitic cobalt or nickel alloy and have an outer surface hardened to a certain depth. However, such alloys may prove difficult to machine for the manufacture of pivot arbors. Moreover, they are relatively expensive because of the high cost of nickel and cobalt.

SUMMARY OF THE INVENTION

It is an object of the invention to overcome the aforementioned drawbacks by proposing a pivot arbor which both limits sensitivity to magnetic fields and can obtain mechanical properties able to meet the demands for shock resistance required in the horological industry.

It is yet another object of the invention to provide a non-magnetic pivot arbor which can be manufactured simply and economically.

To this end, the invention relates to a pivot arbor for a timepiece movement comprising at least one pivot made of a first non-magnetic metal material, at at least one of its ends, in order to limit its sensitivity to magnetic fields, at least the outer surface of said pivot being coated with a first layer of a second material selected from the group comprising Ni, NiB and NiP.

According to the invention, at least said first layer of second material is at least partially coated with a second layer of a third material selected from the group comprising gold, silver, copper, platinum, rhodium, palladium and their alloys.

Consequently, the pivot arbor according to the invention makes it possible combine the advantages of low sensitivity to magnetic fields and, at least in the main stress areas, of excellent shock resistance. Hence, in the event of a shock, the pivot arbor according to the invention does not exhibit any marks or any severe damage liable to impair the chronometry of the movement.

Furthermore, the arbors according to the invention exhibit a better mechanical resistance, improved tribological properties, but also better chemical resistance against the lubricants conventionally used to lubricate the arbors.

In accordance with other advantageous features of the invention:

- the first layer of second material has a thickness comprised between 0.5 μm and 10 μm, preferably between 1 μm and 5 μm, and more preferentially between 1 μm and 2 μm;
- the first layer of second material preferably has a hardness of more than 400 HV, more preferentially more than 500 HV;
- the first layer of second material is preferably a chemical NiP layer, i.e. obtained by chemical deposition;
- the second layer of third material has a thickness comprised between 0.1 μm and 1 μm, preferably between 0.1 μm and 0.5 μm;
- the second layer of third material is preferably a gold-based layer deposited by electroplating.

Moreover, the invention relates to a timepiece movement comprising a pivot arbor as defined above, and in particular a balance staff, a pallet staff and/or an escape pinion comprising an arbor as defined above.

Finally, the invention relates to a method for manufacturing a pivot arbor as defined above, comprising the following steps:

a) forming a pivot arbor comprising at least one pivot made of a first non-magnetic metal material, at at least one of its ends, to limit its sensitivity to magnetic fields;

b) depositing a first layer of a second material on at least the outer surface of said pivot, said second material being selected from the group comprising Ni, NiB and NiP, and c) at least partially depositing on the first layer of second material a second layer of a third material selected from the group comprising gold, silver, copper, platinum, rhodium, palladium and their alloys.

In accordance with other advantageous features of the invention:

- the first layer of second material is deposited in step b) to exhibit a thickness comprised between 0.5 μm and 10 μm, preferably between 1 μm and 5 μm, and more preferentially between 1 μm and 2 μm;
- the second material is NiP and step b) consists of a NiP deposition in a process of chemical nickel deposition from hypophosphite;
- the second layer of third material is deposited in step c) to exhibit a thickness comprised between 0.1 μm and 1 μm, preferably between 0.1 μm and 0.5 μm;
- the third material is gold and step c) consists of a gold electroplating operation.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

In the present description, the term "non-magnetic" means a paramagnetic or diamagnetic or antiferromagnetic material, whose magnetic permeability is less than or equal to 1.01.

An alloy of an element is an alloy containing at least 50 wt % of said element.

The invention relates to a component for a timepiece movement and particularly to a non-magnetic pivot arbor for a mechanical timepiece movement.

The invention will be described below with reference to an application to a non-magnetic balance staff 1. Of course, other types of timepiece pivot arbors may be envisaged such as, for example, timepiece wheel set arbors, typically escape pinions or pallet staffs. Components of this type have a body with a diameter preferably less than 2 mm, and pivots with a diameter preferably less than 0.2 mm, with a precision of several microns.

Figure 1:
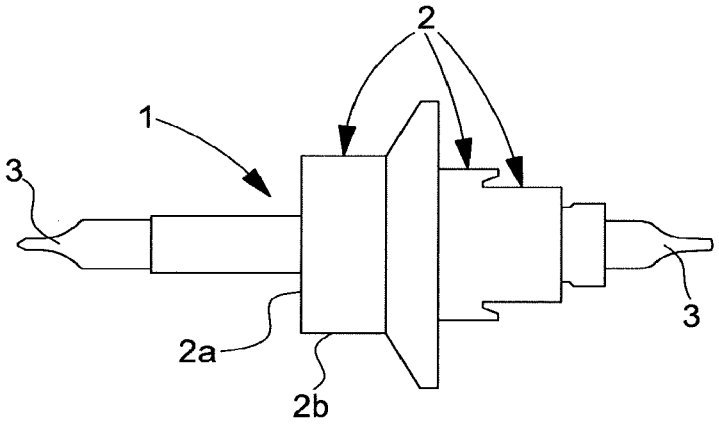
FIG. 1 is a representation of a pivot arbor according to the invention.

Referring to FIG. 1, there is shown a balance staff 1 according to the invention, which comprises a plurality of sections 2 of different diameters, preferably formed by bar turning or any other chip removal machining technique, and defining, in a conventional manner, bearing surfaces 2*a* and shoulders 2*b* arranged between two end portions defining two pivots 3. These pivots are each intended to pivot in a bearing typically in an orifice in a jewel or ruby.

With the magnetism induced by objects that are encountered on a daily basis, it is important to limit the sensitivity of balance staff 1 to avoid affecting the working of the timepiece in which it is incorporated.

Thus, pivot 3 is made of a first a non-magnetic metal material 4 so as to advantageously limit its sensitivity to magnetic fields.

Preferably, the first non-magnetic metal material 4 is selected from the group comprising an austenitic, preferably stainless steel, an austenitic cobalt alloy, an austenitic nickel alloy, a non-magnetic titanium alloy, a non-magnetic aluminium alloy, a brass (Cu—Zn) or a special brass (Cu—Zn with Al and/or Si and/or Mn), a copper-beryllium, a bronze (Cu—Sn), an aluminium bronze, a copper-aluminium (optionally comprising Ni and/or Fe), a copper-nickel, a nickel silver (Cu—Ni—Zn), a copper-nickel-tin, a copper-nickel-silicon, a copper-nickel-phosphorus, a copper-titanium, wherein the proportions of the various alloying elements are chosen to give the alloys both non-magnetic properties and good machinability.

For example, the austenitic steel is a high interstitial stainless austenitic steel such as Cr—Mn—N P2000 steel from Energietechnik Essen GmbH.

The austenitic cobalt alloy may contain at least 39% of cobalt, typically an alloy known under the name of "Phynox" or the reference DIN K13C20N16Fe15D7, typically having 39% of Co, 19% of Cr, 15% of Ni and 6% of Mo, 1.5% of Mn, 18% of Fe and the remainder is additives.

The austenitic nickel alloy may contain at least 33% of nickel, typically an alloy known under the reference MP35N® typically having 35% of Ni, 20% of Cr, 10% of Mo, 33% of Co and the remainder is additives.

The titanium alloy preferably contains at least 85% of titanium.

The brasses may comprise the alloys CuZn39Pb3, CuZn37Pb2 or CuZn37.

The special brasses may comprise the alloys CuZn37Mn3Al2PbSi, CuZn23Al3Co or CuZn23Al6Mn4Fe3Pb.

The nickel silver may comprise the alloys CuNi25Zn11Pb1Mn, CuNi7Zn39Pb3Mn2 or CuNi18Zn19Pb1.

The bronzes may comprise the alloys CuSn9 or CuSn6.

The aluminium bronzes may comprise the alloys CuAl9 or CuAl9Fe5Ni5.

The copper-nickel alloys may comprise the alloy CuNi30.

The copper-nickel-tin alloys may comprise the alloys CuNi15Sn8, CuNi9Sn6 or CuNi7.5Sn5 (marketed, for example, under the name Declafor).

The copper-titanium alloys may comprise the alloy CuTi3Fe.

The copper-nickel-silicon alloys may comprise the alloy CuNi3Si.

The copper-nickel-phosphorus alloys may comprise the alloy CuNi1P.

The copper-beryllium alloys may comprise the alloys CuBe2Pb or CuBe2.

The composition values are given in mass percent. The elements with no indication of the composition value are either the remainder (majority) or elements whose percentage in the composition is less than 1 wt %.

The non-magnetic copper alloy may also be an alloy having a mass percent composition of between 14.5% and 15.5% of Ni, between 7.5% and 8.5% of Sn, at most 0.02% of Pb and the remainder is Cu. Such an alloy is marketed under the trademark ToughMet® by Materion.

Of course, other non-magnetic alloys may be envisaged, provided the proportion of their constituents confers both non-magnetic properties and good machinability.

The first non-magnetic metal material generally has a hardness of less than 600 HV.

Figure 2:
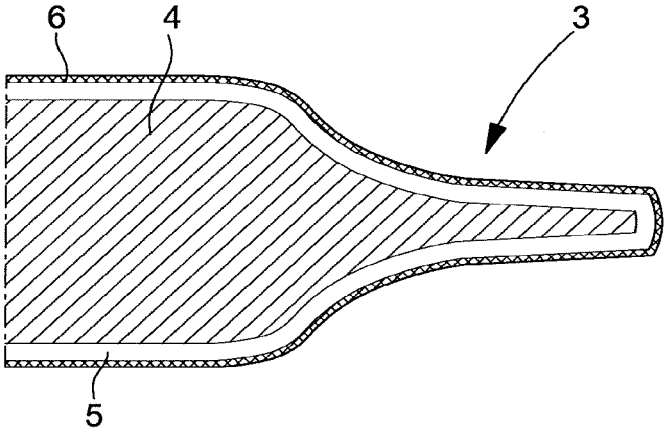
FIG. 2 is a partial cross-section of a balance staff pivot according to the invention.

As shown in FIG. 2, at least the outer surface of said pivot 3 is coated with a first layer 5 of a second material selected from the group comprising Ni, NiB and NiP, in order advantageously to offer, in particular, mechanical properties in said outer surface making it possible to obtain the required shock resistance.

In the second material, the phosphorus content may preferably be comprised between 0% (in which case there is pure Ni) and 15%. Preferably, the level of phosphorus in the second NiP material may be a medium level comprised between 6% and 9%, or a high level comprised between 9% and 12%. It is quite clear however that the second NiP material may have a low phosphorus content.

In the second material, the boron content may preferably be comprised between 0% (in which case there is pure Ni) and 8%. Preferably, the level of boron in the second NiB material may be a medium level comprised between 4% and 5%.

Further, a heat treatment may be performed between steps b) and c) and/or after step c). For example, when the second material is NiB, or NiP with a medium or high level of phosphorus, the first layer of the second NiB or NiP material may advantageously be hardened by heat treatment.

The first layer of second material preferably has a hardness of more than 400 HV, more preferentially more than 500 HV.

In a particularly advantageous manner, the first layer of the second, non-hardened Ni or NiP material preferably has a hardness higher than 500 HV, but lower than 600 HV, i.e. preferably comprised between 500 HV and 550 HV. In a surprising and unexpected manner, the pivot arbor according to the invention has excellent shock resistance although the layer of second material may have a lower hardness (HV) than that of the first material.

When hardened by heat treatment, the first layer of second NiP material may have a hardness comprised between 900 HV and 1000 HV.

The first layer of the second, non-hardened NiB material preferably has a hardness of more than 500 HV, and may have a hardness of more than 1000 HV when it is hardened by heat treatment.

Advantageously, the first layer of second material may have a thickness comprised between 0.5 μm and 10 μm, preferably between 1 μm and 5 μm, and more preferentially between 1 μm and 2 μm.

Preferably, the first layer of second material is a NiP layer, and more particularly a layer of chemical NiP, i.e. deposited by chemical deposition.

In another variant embodiment, the first layer of second material is a NiB layer, and more particularly a layer of chemical NiB, i.e. deposited by chemical deposition.

According to the invention, at least the first layer 5 of second material is at least partially coated with a second layer 6 of a third material selected from the group containing gold, silver, copper, platinum, rhodium, palladium, used in pure form or in alloy form. Said second layer 6 is of smaller thickness than that of first layer 5. Advantageously, second layer 6 of third material may have a thickness comprised between 0.1 μm and 1 μm, preferably between 0.1 μm and 0.5 μm.

Preferably, the third material is 24 carat gold, possibly with a few traces of other elements. For example, 99.7-99.8% gold with 0.02-0.03% of Ni or Co is used.

Combinations associating the following are particularly preferred:

- a copper-beryllium alloy, and more particularly CuBe3Pb, as the first non-magnetic metal material, coated with a layer of chemical NiP as first layer 5 of second material, itself coated with a gold layer as second layer 6 of third material
- a copper-nickel-tin alloy, and more particularly Declafor or ToughMet®, as the first non-magnetic metal material, coated with a layer of chemical NiP as first layer 5 of second material, itself coated with a gold layer as second layer 6 of third material
- a stainless steel, and more particularly a high interstitial stainless steel, as the first non-magnetic metal material, coated with a layer of chemical NiP as first layer 5 of second material, itself coated with a gold layer as second layer 6 of third material.

Consequently, at least the outer surface area of the pivot is hardened, i.e. the rest of the arbor may remain little modified or unmodified without any significant change in the mechanical properties of balance staff 1. This selective hardening of pivots 3 of balance staff 1 makes it possible to combine advantages like low sensitivity to magnetic fields and mechanical properties allowing a very good shock resistance to be obtained, in the main stress areas. Furthermore, the second layer of third material, of smaller thickness, forms the outer layer of the pivot of the invention, and forms a protective layer. More particularly, the second layer of third material allows the surface of the pivot of the invention to be made chemically inert and limits the degradation of the first layer of second material through friction with the jewels and/or through chemical reaction with the lubricant used.

In order to improve the resistance of the first layer of second material, the pivot arbor may comprise at least one adhesion sub-layer deposited between the first material and the first layer of second material. For example, particularly in the case of a pivot arbor made of high interstitial stainless steel, a sub-layer of gold and/or a sub-layer of electroplated nickel may be provided underneath the first layer of second material.

The invention also relates to the method of manufacturing a balance staff as explained above. The method of the invention advantageously comprises the following steps:

a) forming, preferably by bar turning or any other chip removal machining technique, a balance staff 1 comprising at least one pivot 3 made of a first non-magnetic metal material at each of its ends, to limit its sensitivity to magnetic fields;

b) depositing a first layer 5 of a second material on at least the outer surface of said pivot 3, said second material being selected from the group comprising Ni, NIB and NiP in order to improve the mechanical properties of the pivots to obtain a suitable shock resistance at least in the main stress areas; and c) at least partially depositing on first layer 5 of second material a second layer 6 of a third material selected from the group comprising gold, silver, copper, platinum, rhodium, palladium and their alloys.

Preferably, first layer 5 of second material is deposited in step b) to exhibit a thickness comprised between 0.5 μm and 10 μm, preferably between 1 μm and 5 μm, and more preferentially between 1 μm and 2 μm.

Advantageously, step b) of depositing first layer 5 of second material may be achieved by a method selected from the group comprising PVD, CVD, ALD, electroplating and chemical deposition, and preferably chemical deposition.

According to a particularly preferred embodiment, the second material is NiP and the step of depositing NiP layer 5 is produced by a process of chemical nickel deposition from hypophosphite.

The various parameters to be taken into account for chemical nickel deposition from hypophosphite, such as the level of phosphorus in the deposition, the pH, the temperature, or the nickel bath composition, are known to those skilled in the art. Reference will be made, for example, to the publication of Y. Ben Amor et al., *Dépôt chimique de nickel, synthèse bibliographique, Matériaux & Techniques* 102, 101 (2014). However, it will be specified that commercial baths with a medium (6-9%) or high (9-12%) phosphorus level are preferably used. It is quite clear however that low phosphorus content or pure nickel baths can also be used.

According to another embodiment, the second material is NiB and the step of depositing NiB layer 5 is produced by a process of chemical nickel deposition from boron compounds.

Preferably, second layer 6 of third material is deposited on first layer 5 to exhibit a thickness comprised between 0.1 μm and 1 μm, preferably between 0.1 μm and 0.5 μm.

Advantageously, step c) of depositing second layer 6 of third material is achieved by a method selected from the group comprising PVD (sputtering, evaporation or other), CVD and electroplating deposition. According to a particularly preferred embodiment, the third material is gold and the step of depositing gold layer 6 is achieved by electroplating. These methods are known to those skilled in the art and do not require detailed description.

When the second material is NiB or NiP, preferably with a medium or high phosphorus content, the method according to the invention may also comprise, between steps b) and c), and/or after deposition step c), a heat treatment step d). Such a heat treatment makes it possible to obtain a first layer 5 of second material having a hardness preferably comprised between 900 HV and 1000 HV. Preferably, heat treatment step d) is performed after step c). A heat treatment step on the first material may also be provided before step a) or step b).

The chemical nickel deposition method is particularly advantageous in that it makes it possible to obtain a suitable deposition without a peak effect. It is therefore possible to anticipate the dimension of the bar turned pivot arbor to obtain the desired geometry after coating with the layer of second material.

The chemical nickel deposition method also has the advantage of being capable of being applied in bulk.

In order to improve the resistance of the first layer of second material, the method according to the invention may also comprise, before deposition step b), a step d) of applying at least one adhesion sub-layer on the first material. For example, particularly in the case of a pivot arbor made of high interstitial stainless steel, it is possible to apply a gold sub-layer and/or an electroplated nickel sub-layer before the chemical nickel deposition.

The pivot arbor according to the invention may comprise pivots treated according to the invention by applying steps b) and c) only to the pivots, with the second layer 6 of third material partially or completely coating the pivot by applying step c) over one part or over the entire surface of the pivot.

The pivot arbor according to the invention may also be made entirely of a first non-magnetic metal material, its outer surface may be entirely coated with a first layer of second material by applying step b) over all the surfaces of the pivot arbor, said first layer of second material being then partially or entirely coated with a second layer of a third material selected from the group comprising gold, silver, copper, platinum, rhodium, palladium and their alloys, by applying step c) on one part or on all the surfaces of the pivot arbor.

In a known manner, pivots 3 may be rolled or polished before or after deposition step b), to attain the dimensions and final surface finish required for pivots 3.

The pivot arbor according to the invention combines the advantages of low sensitivity to magnetic fields, and at least in the main stress areas, excellent resistance to shocks. Hence, in the event of a shock, the pivot arbor according to the invention does not exhibit any marks or any severe damage liable to impair the chronometry of the movement.

Further, the arbors according to the invention exhibit better mechanical resistance, better tribological properties, but also better chemical resistance to the lubricants conventionally used to lubricate the arbors.

What is claimed is:

1. A pivot arbor for a timepiece movement, comprising:

at least one pivot made of a first non-magnetic metal material at at least one end of the at least one pivot that limits sensitivity of the at least one pivot to a magnetic field, wherein the first non-magnetic metal material is selected from the group consisting of an austenitic cobalt alloy, a titanium alloy, an aluminium alloy, a copper and zinc-based brass, a copper-beryllium, a nickel silver, a bronze, an aluminium bronze, a copper-aluminium, a copper-nickel, a copper-nickel-tin, a copper-nickel-silicon, a copper-nickel-phosphorus, and a copper-titanium, wherein at least an outer surface of the at least one pivot is coated with a first layer of a second material, wherein the second material consists of Ni, NiB, NiP, or a combination thereof and is different from the first non-magnetic metal material, and wherein the first layer of the second material is at least partially coated with a second layer of a third material selected from the group consisting of gold, silver, copper, platinum, rhodium, palladium, and an alloy thereof.

2. The pivot arbor according to claim 1, wherein the second material is chemical NiP.

3. The pivot arbor according to claim 1, wherein the first non-magnetic metal material has a hardness of less than 600 HV.

4. The pivot arbor according to claim 1, wherein the first layer of the second material has a thickness of from 0.5 μm to 10 μm.

5. The pivot arbor according to claim 4, wherein the first layer of the second material has a thickness of from 1 μm to 5 μm.

6. The pivot arbor according to claim 5, wherein the first layer of the second material has a thickness of from 1 μm to 2 μm.

7. The pivot arbor according to claim 1, wherein the first layer of the second material has a hardness of more than 400 HV.

8. The pivot arbor according to claim 7, wherein the first layer of the second material has a hardness of more than 500 HV.

9. The pivot arbor according to claim 1, wherein the second layer of the third material has a thickness of from 0.1 μm to 1 μm.

10. The pivot arbor according to claim 9, wherein the second layer of the third material has a thickness of from 0.1 μm to 0.5 μm.

11. The pivot arbor according to claim 1, wherein the first non-magnetic metal material is a copper-beryllium alloy, wherein the first layer of the second material is a chemical NiP layer, and wherein the second layer of the third material is a gold layer.

12. The pivot arbor according to claim 1, wherein the first non-magnetic metal material is a copper-nickel-tin alloy, wherein the first layer of the second material is a chemical NiP layer, and wherein the second layer of the third material is a gold layer.

13. A movement for a timepiece, comprising:

the pivot arbor of claim 1.

14. A movement for a timepiece, comprising:

at least one selected from the group consisting of a balance staff, a pallet staff, and an escape pinion, and the pivot arbor of claim 1.

15. The pivot arbor according to claim 1, wherein the first non-magnetic material is a paramagnetic, diamagnetic, or antiferromagnetic material, having magnetic permeability of 1.01 or less.

16. The pivot arbor according to claim 1, wherein the at least one pivot has a diameter of less than 0.2 mm.

17. The pivot arbor according to claim 1, wherein the first non-magnetic metal material is a titanium alloy comprising at least 85% of titanium.

18. The pivot arbor according to claim 1, wherein the first non-magnetic metal material is a copper alloy comprising from 14.5 mass % to 15.5 mass % of Ni, from 0.5 mass % to 8.5 mass % of Sn, at most 0.02 mass % of Pb, and the remainder is Cu.

19. A method for fabricating a pivot arbor for a timepiece movement, the method comprising:

a) forming a pivot arbor comprising at least one pivot made of a first non-magnetic metal material at at least one end of the at least one pivot that limits sensitivity of the at least one pivot to a magnetic field, wherein the first non-magnetic metal material is selected from the group consisting of an austenitic cobalt alloy, a titanium alloy, an aluminium alloy, a copper and zinc-based brass, a copper-beryllium, a nickel silver, a bronze, an aluminium bronze, a copper-aluminium, a copper-nickel, a copper-nickel-tin, a copper-nickel-silicon, a copper-nickel-phosphorus, and a copper-titanium;

b) depositing a first layer of a second material on at least an outer surface of the pivot arbor, wherein the second material consists Ni, NiB, NiP, or a combination thereof and is different from the first non-magnetic metal material; and c) at least partially depositing, on the first layer of the second material, a second layer of a third material selected from the group consisting of gold, silver, copper, platinum, rhodium, palladium and an alloy thereof.

20. The method according to claim 19, wherein the first layer of the second material is deposited such that a thickness of from 0.5 μm and 10 μm.

21. The method according to claim 20, wherein the first layer of the second material has a thickness of from between 1 μm and 5 μm.

22. The method according to claim 21, wherein the first layer of second material has a thickness of from 1 μm and 2 μm.

23. The method according to claim 19, wherein the depositing in b) is conducted by a method selected from the group consisting of PVD, CVD, ALD, electroplating, and chemical deposition.

24. The method according to claim 23, wherein the second material is NiP, and wherein the depositing in b) is conducted by a chemical nickel deposition from hypophosphite.

25. The method according to claim 19, wherein the second layer of the third material is deposited such that a thickness is from 0.1 μm and 1 μm.

26. The method according to claim 25, wherein the second layer of the third material is deposited such that a thickness is from 0.1 μm and 0.5 μm.

27. The method according to claim 19, wherein the depositing in c) is conducted by a method selected from the group consisting of PVD, CVD, and electroplating deposition.

28. The method according to claim 19, wherein the second material is NiP or NiB, and wherein the method further comprises, between b) and c) and/or after c), a heat treatment d).

* * * * *